US005219898A

United States Patent [19]

Irwin

[11] Patent Number: 5,219,898

[45] Date of Patent: Jun. 15, 1993

[54] SPIN DOPES FROM POLY[2,2'-BIS(TRIFLUOROMETHYL)BENZIDINE TEREPHTHALAMIDE] AND FROM POLY[2,2'-BIS(1,1,2,2-TETRAFLUOROETHOXY BENZIDINE TEREPHTHALAMIDE]

[75] Inventor: Robert S. Irwin, Wilmington, Del.

[73] Assignee: E. I. Du Pont de Nemours and Company, Wilmington, Del.

[21] Appl. No.: 868,689

[22] Filed: Apr. 15, 1992

Related U.S. Application Data

[63] Continuation-in-part of Ser. No. 538,060, Jun. 13, 1990, Pat. No. 5,122,416.

[51] Int. Cl.[5] ..... C08K 5/34

[52] U.S. Cl. ..... 524/104; 524/211; 524/233

[58] Field of Search ..... 524/104, 211, 233

[56] References Cited

U.S. PATENT DOCUMENTS

| | | | |
|---|---|---|---|
| 4,495,321 | 1/1985 | Arnold | 524/104 |
| 4,529,763 | 7/1985 | Tamura et al. | 524/233 X |
| 4,595,708 | 6/1986 | Sundet | 524/233 X |
| 4,857,569 | 8/1989 | Cotts et al. | 524/211 X |
| 4,959,453 | 9/1990 | Sweeny | 524/104 X |
| 5,006,593 | 4/1991 | Brasure et al. | 524/520 |

FOREIGN PATENT DOCUMENTS

| | | | |
|---|---|---|---|
| 0106564 | 8/1979 | Japan | 524/211 |

OTHER PUBLICATIONS

J. Macromol. Sci.-Chem., A23 (7), pp. 905-914 (1986).
Journal of Polymer Science: Polymer Chemistry Edition, vol. 23, pp. 2669-2678 (1985).
Journal of Polymer Science: Part A: Polymer Chemistry, vol. 25, pp. 1249-1271 (1987).
Macromolecules 1985, vol. 18, pp. 1058-1068.

*Primary Examiner*—Joseph L. Schofer
*Assistant Examiner*—J. M. Reddick

[57] ABSTRACT

Anisotropic solutions are prepared from poly[2,2'-bis(-trifluoromethyl)benzidine terephthalamide] or poly[2,2'-bis(1,1,2,2-tetrafluoroethoxy)benzidine terephthalamide] in amide solvents containing certain chlorides in specified amount. Crystalline fibers are prepared from the polymers.

3 Claims, 1 Drawing Sheet

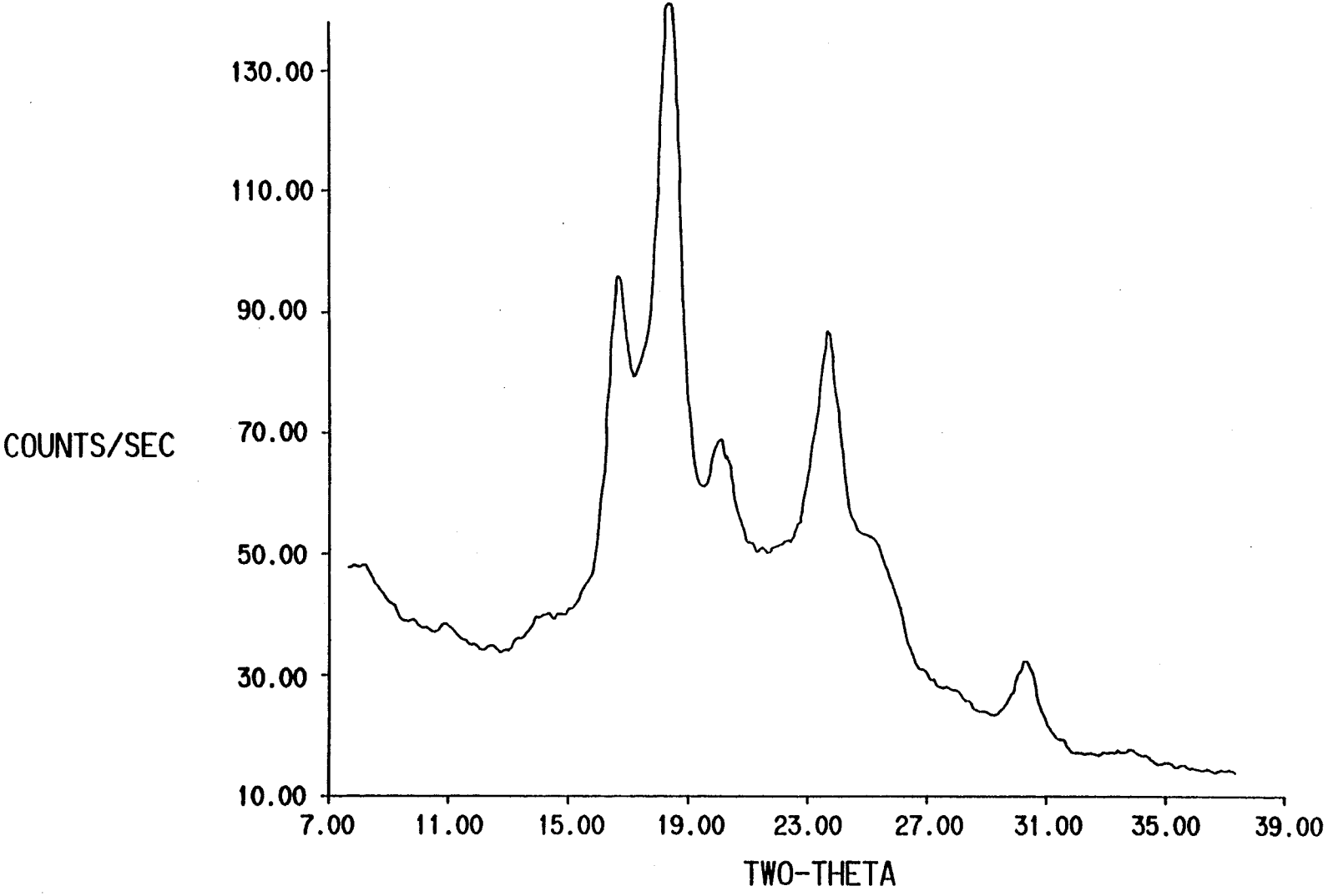
COUNTS/SEC
130.00
110.00
90.00
70.00
50.00
30.00
10.00
7.00
11.00
15.00
19.00
23.00
27.00
31.00
35.00
39.00
TWO-THETA

SPIN DOPES FROM POLY[2,2'-BIS(TRIFLUOROMETHYL)BENZIDINE TEREPHTHALAMIDE] AND FROM POLY[2,2'-BIS(1,1,2,2-TETRAFLUOROETHOXY BENZIDINE TEREPHTHALAMIDE]

RELATED APPLICATIONS

This application is a continuation-in-part of my U.S. patent application Ser. No. 07/538,060 filed Jun. 13, 1990 and now U.S Pat. No. 5,122,416.

BACKGROUND OF THE INVENTION

At normal spinning dope concentrations, poly[2,2'-bis(triflouromethyl)benzidine terephthalamide] (FPP-T) in dimethylacetamide (DMAc) gives isotropic solutions. The polymer itself is reported to be amorphous. These properties are entirely out of character compared to the closely related structure, poly(p-phenyleneterephthalamide) and to most other para-aramids. The preparation of anisotropic spin dopes of FPP-T and crystalline fibers therefrom is a worthwhile objective.

FIGURE

The FIGURE is an equatorial x-ray diffraction scan of a hot-stretched fiber of Example 6 below.

SUMMARY OF THE INVENTION

This invention provides anisotropic spin dopes of poly[2,2'-bis(trifluoromethyl)benzidine terephthalamide] and of poly[2,2'-bis(1,1,2,2-tetrafluoroethoxy)benzidine terephthalamide] in an amide solvent selected from N-methylpyrrolidone, dimethylacetamide and tetramethylurea, containing specified amounts of calcium chloride, lithium chloride or hydrogen chloride per amide bond. In the case FPP-T the solution contains from about 0.75 to about 4 equivalents of calcium chloride, lithium chloride or hydrogen chloride per amide bond, while in the case of poly[2,2'-bis(1,1,2,2-tetrafluoroethoxy)benzidine terephthalamide] the solution contains from about 0.75 to about 5.5 equivalents of calcium chloride, lithium chloride or hydrogen chloride per amide bond.

DETAILED DESCRIPTION OF THE INVENTION

Poly[2,2'-bis(trifluoromethyl)benzidine terephthalamide] is a known highly amorphous polymer [see Rogers et al., J. Macromol Sci-Chem., A23 (7), pp 905–914, at 911 (1986)]. While soluble in amide solvents such as dimethyl acetamide (DMAc) tetramethylurea, (TMU) and N-methylpyrrolidone (NMP), the polymer solutions do not exhibit lyotropic (anisotropic) behavior (see Rogers et al., Macromolecules 1985, V. 18, pp 1058–1068 at 1061, 1062).

The FPP-T anisotropic dopes of the present invention consist essentially of FPP-T in an amide solvent containing from about 0.75 up to about 4 equivalents of calcium chloride, lithium chloride or hydrogen chloride per amide bond of the polymer. The poly[2,2'-tetrafluoroethyoxy)benzidine terephthalamide]anisotropic dopes of the invention consist essentially of the polymer in an amide solvent containing from about 0.75 to about 5.5 equivalents of calcium chloride, lithium chloride or hydrogen chloride per amide bond of the polymer. The dopes may be prepared by dissolving the polymer in NMP, DMAc or TMU at a concentration of 4% to 16% preferably from 5 to 11%. To this solution is added the requisite amount of calcium chloride, lithium chloride or hydrogen chloride per amide bond of the polymer. If one starts with the dihydrochloride of the polymer, the HCl may be formed in situ. With no ionizable species or alternatively with above the specified upper limit of equivalents per amide bond, the solutions are isotropic at normal spinning dope polymer concentrations.

It is believed that anisotropy of the dope is a manifestation of nematic liquid crystallinity, which makes possible a substantial degree of macromolecular alignment in the as-spun fiber. In such a state that application of an extensional force to the as-spun fiber at high temperature induces crystallization which process substantially improves macromolecular orientation to give high T/Mi. Isotropy by contrast gives negligible macromolecular orientation to the fiber as-spun and improvement to high levels by hot stretching from such as base, is not possible because substantial drawability is opposed by macromolecular tangles and the like.

The polymer molecular weight suitable for purposes of the present invention can vary considerably. A preferred range as measured in terms of inherent viscosity (in sulfuric acid or in alkylamide solvent containing no ionizable species) is 2 to 9 dL/g.

The anisotropic spin dopes are wet-spun into coagulation baths to form amorphous fibers. Aqueous baths at temperatures of −5° C. to 50° C. may be employed. The as-spun fibers obtained by wet spinning the anisotropic FPP-T dopes may exhibit a tenacity/modulus (T/Mi) of ~5/~180 grams per denier (gpd) or higher. The as-spun fibers O.A.~24° C., C.I.~18 are heated with or without tension to obtain crystalline fiber. Temperatures in excess of 250° C. are normally employed. When heat-treated without tension at above 300° C., there results appreciable crystallization, an improvement in orientation angle and about a 50% increase in T/Mi. Applying a tension during the heat treatment results in a substantial increase in strength. Heat-treatment with tension, i.e., with up to 12% stretch, produces highly oriented crystalline fiber, O.A.<15, C.I.>25, and about a 100% increase in T/Mi.

TESTS AND MEASUREMENTS

Anisotropy was established qualitatively by observation of a bright field in a polarizing microscope between crossed polarizers.

Molecular weight was assessed in terms of inherent viscosity either in sulfuric acid or alkylamide solvent containing no ionizable species.

Orientation Angle (O.A.)

A bundle of filaments about 0.5 mm in diameter is wrapped on a sample holder with care to keep the filaments essentially parallel. The filaments in the filled sample holder are exposed to an x-ray beam produced by a Philips x-ray generator (Model 1204B) operated at 40 kv and 40 ma using a copper long fine-focus diffraction tube (Model PW 2273/20) and a nickel beta-filler.

The diffraction pattern from the sample filaments is recorded on Kodak DEF Diagnostic Direct Exposure X-ray film (Catalogue Number 154-2463), in a Warhus pinhole camera. Collimators in the camera are 0.64 mm in diameter. The exposure is continued for about fifteen to thirty minutes (or generally long enough so that the diffraction feature to be measured is recorded at an Optical Density of ~1.0).

A digitized image of the diffraction pattern is recorded with a video camera. Transmitted intensities are calibrated using black and white references, and gray level is converted into optical density. A data array equivalent to an azimuthal trace through the two selected peaks is created by interpolation from the digital image data file; the array is constructed so that one data point equals one-third of one degree in arc.

The Orientation Angle is taken to be the arc length in degrees at the half-maximum optical density (angle subtending points of 50 percent of maximum density) of the equatorial peaks, corrected for background. This is computed from the number of data points between the halfheight points on each side of the peak. Both peaks are measured and the Orientation Angle is taken as the average of the two measurements.

Crystallinity Index (C.I.)

Crystallinity Index is derived from an equatorial x-ray diffraction scan, obtained with an x-ray diffractometer (Philips Electronic Instruments; cat. no. PW1075/00) in either reflection or transmission mode, using a diffracted-beam monochromator and a scintillation detector. Intensity data are measured with a rate meter and recorded by a computerized data collection/reduction system. Diffraction patterns are obtained using he instrumental settings:

Scanning time ~30" per step;
Stepping Increment 0.05 TTH;
Scan Range 7.5 to 37.5, TTH; and
Pulse Height Analyzer, "Differential".

The diffraction data are processed by a computer program that smooths the data, determines the baseline, and then fits a broad Gaussian peak under the narrow crystalline peaks to represent the scattering from the amorphous component of the structure. If the area under the diffraction scan, after substracting the background (baseline), is T, and the area under the broad amorphous scatter is A, then the Crystallinity Index is:

$$CI = \frac{T - A}{A} \times 100$$

The following examples are submitted to illustrate the invention and are not intended as limiting.

EXAMPLE 1

2,2'-Bis(trifluoromethyl)benzidine (8.534 g. 0.0267 mole), dissolved in anhydrous DMAc (108 g., 114 mole) in a flamed-out resin kettle, under a slow stream of dry nitrogen, was cooled to about 10° C. Then all at once, terephthaloyl chloride (5.414 g. 0.0267 mole) was added with efficient stirring. An external cooling bath was used to prevent excessive temperature increase. The initially clear solution quickly changed to a gel which was sufficiently hard that continued stirring turned it into a crumb-like material. The gel contained 10% FPP-T and 1.6% solution in DMAC/HCl. From the flow time relative to that of pure DMAc, its $\eta_{inh}$ was 8.97. The precipitated polymer was redissolved in various solutions and, the following inherent viscosity values were obtained:

| Solvent | $\eta_{inh}$ | Equiv. of Salt (or HCl) per Polymer Repeat Unit |
|---|---|---|
| DMAc/0.08% HCl | 8.97 | 2 |

-continued

| Solvent | $\eta_{inh}$ | Equiv. of Salt (or HCl) per Polymer Repeat Unit |
|---|---|---|
| DMAc/0.25% $CaCl_2$ | 6.87 | 4 |
| DMAc/4.0% $CaCl_2$ | 2.98 | 64 |
| DMAc/4.0% LiCl | 2.95 | 85 |
| 100% $H_2SO_4$ | 2.95 | 0 |

EXAMPLE 2

2,2'-bis(trifluoromethyl)benzidine dihydrochloride (17.798 g., 0.0448 mole) of 98.8% purity, in anhydrous DMAc (282 g.) was combined with anhydrous diethylaniline (DEA)(13.34 g.; 0.0896 mole; predistilled from $P_2O_5$) and the solution cooled to 5°-10° C. With stirring, under a slow stream of dry nitrogen, terephthaloyl chloride (9.090 g., 0.0448, mole) was added all at once. There resulted a clear, colorless, viscous, isotropic solution of 5.5 g. FPP-T in DMAc/5.1% DEA.HCl. After stirring 1 hour, anhydrous calcium oxide (2.50 g., 0.0448 mole) was added to give an anisotropic viscous dope containing 5.5% FPP-T/1.5% $CaCl_2$/0.8% $H_2O$/4.1% DEA (i.e., 2 equiv. $CaCl_2$ per polymer repeat unit). Duplicate dilutions to 0.5% solids and $\eta_{inh}$ determination against pure DMAc as standard gave values of 8.49 and 8.85 (which diminished by about 10% on standing 3 weeks at room temperature). A small amount of particulate material, probably CaO, was removed by centrifugation to give a liquid which was opalescent on stirring and highly birefringent under the microscope crossed polarizers.

EXAMPLE 3

The polymer from Example 2 was precipitated by combining the solution with excess water, filtered, washed and dried. It has $\eta_{inh}$=2.60 and 2.51, respectively, in DMAc/4% LiCl and 100% $H_2SO_4$. Solutions were made up as follows, tested for anisotropy and $\eta_{inh}$ determined by dilution to 0.5 % solids with pure solvent.

(a) Solution comparable to dope of Example 2 but at higher (11%) polymer content: FPP-T (1.00 g., 0.00249 mole), DEA.HCl (0.92 g., 7.33 ml) gave a fluid, anisotropic dope. $\eta_{inh}$, measured by dilution with DMAc to 0.5% solids, was 7.29.

(b) Solution at 5.5% polymer solids without DEA.HCl present. Solution was anisotropic and slightly gel-like. $\eta_{inh}$ by dilution with DMAc was 10.18.

(c) Solution at 5.5% polymer solids in DMAc alone. FPP-T (1.00 g.) was dissolved in DMAc (18.0 ml) to give an isotropic viscous solution. $\eta_{inh}$ by dilution was 2.55.

EXAMPLE 4

5.0 g. FPP-T ($\eta_{inh}$=2.95 in 100% $H_2SO_4$) from Example 1 was dissolved in DMAc (5.75 g., 61.5 ml) to form a clear viscous isotropic solution of 8% solids.

In 20 ml of this solution was dissolved LiCl (0.23 g.) i.e., 1.5 equiv. of LiCl per unit. The solution was now hazy, and anisotropy was observed in a polarizing microscope.

In the preceding solution was dissolved an additional 0.20 g. LiCl, i.e., 2.9 equiv. per polymer repeat unit. The solution now became clear, isotropic and more fluid.

EXAMPLE 5

In a 300 ml round-bottomed flask fitted with a stirrer, thermometer, slow nitrogen flow, provision for addition of solids and external cooling bath, a solution was prepared, consisting of 48 ml anhydrous N-methylpyrrolidone, 48 ml anhydrous tetramethylurea, and 7.69 g. anhydrous lithium chloride. 3.219 g. 2,2'-bis(1,1,2,2-tetrafluoroethyoxy)benzidine (0.00774 mole) were added. After cooling to −8° C. 1.575 g terephthaloyl chloride (0.00776 mole) followed by a further 48 ml tetramethylurea was added. The stirred mixture was kept at 0° C. for 30 minutes, then overnight at 21° C. The polymer product poly[2,2'-bis(1,1,2,2-tetrafluoroethoxy) benzidine terephthalamide] was isolated by precipitation in excess water, washed with water, then methanol, and dried.

A 6% solution of polymer in DMAc was progressively treated with dissolved $CaCl_2$ and the effect on isotropy of solution noted (Table). Inherent viscosities were determined by diluting the 6% solution to 0.5% concentration with DMAc and comparing flow rate with that of pure solvent.

TABLE

| Solution | $CaCl_2$ (Equiv. per Polymer Repeat Unit) | Anisotropy (6% Soln.) | Inherent Viscosity |
|---|---|---|---|
| 1 | 0.0 | − | 1.67 |
| 2 | 0.9 | + | 1.47 |
| 3 | 2.8 | + | 3.72 |
| 4 | 4.6 | + | 3.30 |
| 5 | 6.5 | − | 5.50 |

EXAMPLE 6

The anisotropic FPP-T solution of Example 2 in DMAc/DEA/$CaCl_2$ was extruded in a conventional manner at ambient temperature via a 5 hole/0.005" hole diameter spinneret into water at 21° C. The dope was extruded at a linear rate of 3.91 m/min/hole. The fiber was wound up at 8.6 m/min for a spin-stretch of 2.2X. Spinning continuity was excellent. As-spun yarn, soaked overnight in water and dried in air, had $\eta_{inh}$=2.43 (no loss in spinning) in DMAc/4% LiCl. As-spun fibers had average T/E/Mi/toughness/dpf (highest tenacity in parentheses) of 4.6 gpd/7.8%/173 gpd/11.2(4.9/8.2/282/0.25/10.9). They were essentially amorphous, by wide angle X-ray, although quite well oriented (~24°), C.I. ~18 and had a density of 1.466 g/cm$^3$ (±0.12%). Glass transition as determined by differential scanning calorimeter (DSC) was 285° C.; an endotherm of 450° C. is probably associated with melting. Catastrophic decomposition as determined by thermogravimetric analysis (TGA) occurs at 49° C.

The fibers were stretched by up to 12% across a 10 cm hot plate at 450° C. The stress strain curve showed a profound change from having a pronounced yield point or "knee" (as-spun) to almost linear (drawn). Average T/E/Mi toughness changed to 8.7/2.5/390/0.123(11.0/3.2/433/0.187) and O.A. increased to ~10.6° ave. $\eta_{inh}$ increased significantly to 3.38 (in DMAc/4% LiCl) while density remained the same (1.465 g/cm$^3$±0.45). In contrast with as-spun, the drawn fiber was highly crystalline (C.I. ~65). When the hot-stretching was performed at 450° to 500° C. a different crystal form was obtained, having a density (calculated) of 1.56 g/cm$^3$, O.A. ~10.1° ave. C.I. ~58. The Figure is an equatorial x-ray diffraction scan of this fiber. In the high temperature crystal form, there was no improvement in tensile properties or in orientation beyond that obtained with the lower temperature crystalline form.

When as-spun fibers were treated in an oven, in the absence of tension for 16 min. at 300° C., T/E/Mi increased substantially compared with as-spun fiber to 7.2/3.1/293(7.5/3.2/310). Orientation improved to an intermediate degree (~16°), accompanied by a significant increase in crystallinity, although not as much as for the drawn fiber.

I claim:

1. An anisotropic dope of a polymer selected from the group consisting of A) poly[2,2'-bis(trifluoromethyl)-benzidine terephthalamide] and B) poly[2,2'-bis(1,1,2,2-tetrafluoroethoxy)benzidine terephthalamide] in an amide solvent selected from dimethylacetamide, N-methylpyrrolidone and tetramethylurea, and in the case of polymer A, said dope containing from about 0.75 to about 4 equivalents of calcium chloride, lithium chloride or hydrogen chloride per amide bond of polymer while in the case of polymer B said dope containing from about 0.75 to about 5.5 equivalents of calcium chloride, lithium chloride or hydrogen chloride per amide bond of polymer.

2. A dope according to claim 1 wherein from about 4 to 16% of polymer is present.

3. A dope according to claim 1 wherein about 5 to 11% of polymer is present.

* * * * *